US010130147B2

(12) United States Patent
Coe

(10) Patent No.: US 10,130,147 B2
(45) Date of Patent: Nov. 20, 2018

(54) NON-DIRECTIONAL INSTANT LOCKING FASTENER

(71) Applicant: Jaenam Coe, Tujunga, CA (US)

(72) Inventor: Jaenam Coe, Tujunga, CA (US)

( * ) Notice: Subject to any disclaimer, the term of this patent is extended or adjusted under 35 U.S.C. 154(b) by 179 days.

(21) Appl. No.: 14/825,084

(22) Filed: Aug. 12, 2015

(65) Prior Publication Data

US 2017/0042294 A1 Feb. 16, 2017

(51) Int. Cl.
*A44B 11/26* (2006.01)
*A44C 5/20* (2006.01)

(52) U.S. Cl.
CPC ..... *A44B 11/266* (2013.01); *A44C 5/2052* (2013.01)

(58) Field of Classification Search
CPC ... A44B 11/2519; A44B 11/266; A44B 11/25; A44B 11/2061; A44C 5/2057; A44C 5/2052; A44C 5/2061; F16B 21/06; Y10T 24/5602; Y10T 24/45623; Y10T 24/45639; Y10T 24/45717; Y10T 403/591; Y10T 403/595; Y10T 403/599; Y10T 403/32213
See application file for complete search history.

(56) References Cited

U.S. PATENT DOCUMENTS 6,041,479 A * 3/2000 Colpo ..... A44C 5/2052 24/606
6,378,178 B1 * 4/2002 Pedersen ..... A44B 11/2534 24/634
6,883,211 B2 * 4/2005 Hoshino ..... A44C 5/2061 24/663
7,640,639 B2 * 1/2010 de Bien ..... A01K 27/005 119/772

FOREIGN PATENT DOCUMENTS

CH 96026 A * 9/1922 ..... A44C 5/2052
CH 96033 A * 9/1922 ..... A44C 5/2052
DE 29807859 U1 * 7/1998 ..... A44C 5/2052

* cited by examiner

*Primary Examiner* — Joshua T Kennedy

(57) ABSTRACT

An accessibility-enhanced instant locking fastener system comprising of a cylindrical tongue and a catch with funnel-shaped opening, enabling easy insertion and pushing for locking, without precise alignment or directional orientation. The omni-directional locking clasp system, a typical use of which may be for seat belt buckling systems, are configured so that the once the tip of the tongue meets the opening of the hole in the clasp, latching can be accomplished by simply pushing the tongue into the funnel-shaped opening without the necessity to precise directional alignment unlike the flat tongue plates of locking buckles typically found in conventional seat belt harnesses.

5 Claims, 6 Drawing Sheets

NON-DIRECTIONAL INSTANT LOCKING FASTENER

BACKGROUND

Conventional instant locking fasteners, as commonly found in the seat belts of various vehicles require certain level of dexterity and, in some cases, vision, to engage as the conventional fastener designs require precise lateral-directional match of the tongue plate on one side, to fit into the narrow opening of the buckle on the other side, and maintaining the alignment to insert to engage the latch within the buckle's locking structure to fasten. This requirement of matching and aligning embedded in the conventional designs of locking fasteners imposes inconvenience, more time to engage and make them unusable to the users with limited dexterity. So a fastener system with a locking clasp that can be engaged through general pushing of the tongue into the hole of the clasp without precise directional alignment for locking could be valuable in many applications and also available to broader spectrum of users.

SUMMARY

The present invention incorporates a new design of a locking fastener system of a tongue and a clasp where the "tongue" part is generally cylindrical or transversely isotropic, as opposed to the flat design of its conventional counterparts, with a rounded, spheroidal top, and the receiving clasp has a hole with a funnel-shaped opening leading to the insertion channel for the tongue. Once the tip of the tongue is pushed through the flaring opening of the clasp, the tongue will travel through the internal channel so long as the tongue is pushed, regardless of its lateral orientation, and ultimately lock when it reaches the locking point and remain locked when the tongue may pivot. The present invention further incorporates the shape of the tongue that is connected to a knob-shape, bulked handle that is likewise non-directional, and for the dexterity-challenged users to grab with improved accessibility and engage in the latch by pushing without accurately aligning in a more intuitive way because the axis of the tongue will be aligned with the direction of the force asserted by the hand that is holding the knob to push for locking.

An object of an embodiment of the present invention is to provide a design for a fastening device which can be latched without precise lateral aligning of the tongue into the opening of the clasp. Another object of an embodiment of the present invention is to provide a fastening device where the tongue can be pushed in faster, with a user-friendly handle which can be used in engaging the lock by making the gripping or pushing of the knob less demanding precision and force. The non-directional design of the locking mechanisms in the fastener allows the users to lock the tongue in the clasp by pushing in indiscriminant way and the tongue may pivot inside the clasp while maintaining the locked state. This ability to pivot can be beneficial in many applications as well as adding to the overall strength of the lock as the torsional stress between the two parts held by the fastener will be alleviated by pivoting. Another object of an embodiment of the present invention is to provide a locking clasp that can be easily disengaged by a simple push of a button or buttons.

According to an embodiment of the present invention, a fastening device includes an active spheroidal-tip tongue with spring-loaded hooks protruding near its tip and a passive clasp with a funnel-shaped hole where the circular, internal indentation passively catches and locks the tongue once the hooks pass beyond the indentation, regardless of the lateral direction or orientation of the tongue.

According to another embodiment of the present invention, a fastening device includes a clasp with a shell having side walls covering the base plate holding the locking mechanism, one end of the base plate is shaped like a barrel and is to accommodate the funnel-shaped hole formed by the release buttons to guide the tongue into the barrel-shaped insertion channel. The tongue is generally cylindrically shaped to fit the interior of the tubular insertion channel so that there is no required particular lateral orientation to align for insertion into the channel for locking, the tongue having an indentation, a set of latching bars that are adapted to be supported by the side walls so that the latching member can slide between an unlatching position and a latching position, wherein the hole formed by the half arcs of the latching bars choke and lock the tongue when the tongue is inserted into a predetermined position within the fastening device and the latching bars are locked and butted against the frame wall of the insertion channel, an ejector that is located to prevent the tongue from moving when the tongue is latched, a set of blade springs which are positioned to hold the latching bars in latching position, and a set of release keys connected to a release button with a spring over the insertion channel to be compressed by the user for pushing the release keys and move the latching bars apart to release and unlatch the tongue.

According to another embodiment of the present invention, a set of release buttons may be placed on each side of the casing to allow squeezing as opposed to pressing to release the tongue from the locking mechanism.

It is to be understood that both the foregoing general description and the following detailed description are exemplary and explanatory only, and are not restrictive of the invention as claimed.

DESCRIPTION OF THE DRAWINGS

These and other features, aspects, and advantages of the present invention will become apparent from the following description, appended claims, and the accompanying exemplary embodiments shown in the drawings, which are briefly described below.

Embodiments of the present invention will be described below with reference to the drawings. It should be noted that, in the following description, terms "upper", "lower", "above", and "below" refer to "upper", "lower", "above", and "below" in the drawings, respectively, and the terms "right", "left", "rightward, and "leftward" refer to "right", "left", "rightward, and "leftward" refer to "right", "left", "rightward, and "leftward" in the drawings, respectively.

Figure 1:
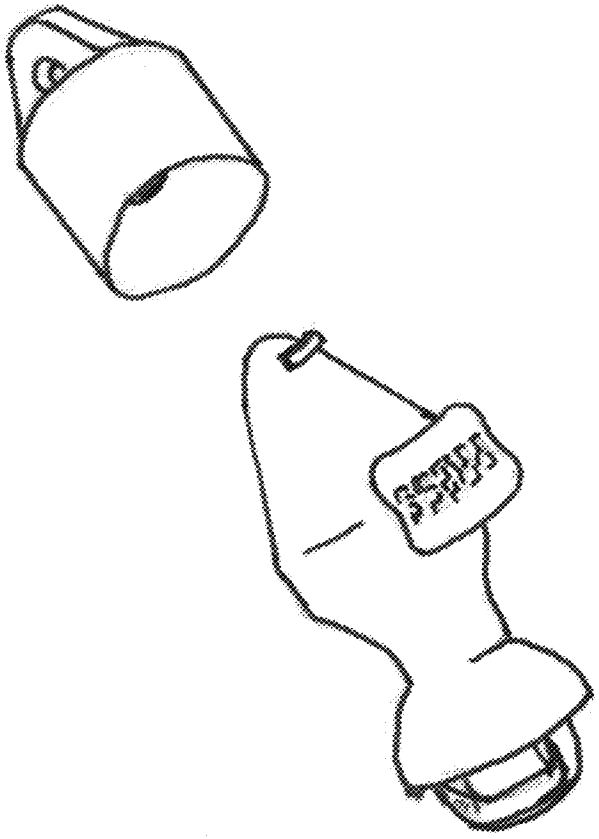
FIG. 1 shows an embodiment of the present invention with a locking tongue and a passive clasp.
Figure 2:
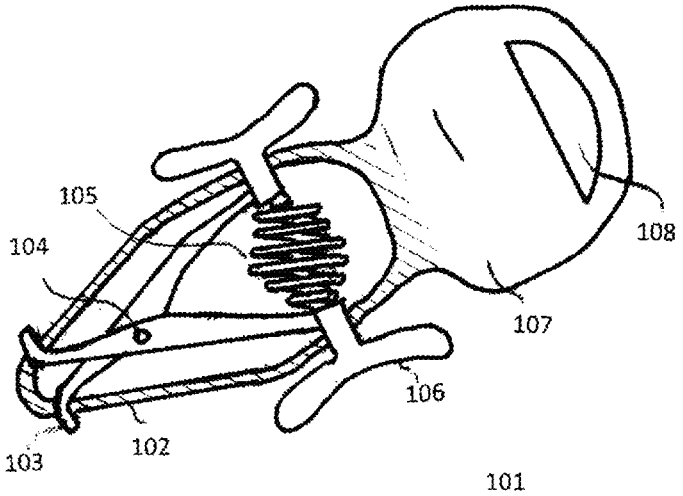
FIG. 2 shows the sectional view of the embodiments in FIG. 1. The tongue 101 has active locking mechanism involving spring (105)-loaded hooks 103 and the clasp 110 has passive catch 113. The outer profile of the tongue is to be round or transversely isotropic shape, like the inner wall 112 of the catch 110. The round circle formed by the catch of the indentation ring 113 allows the tongue to pivot inside the catch while maintaining the locking. The spring inside the tongue 101 provides the pressure to keep the hooks 103 as well as the release buttons 106 protruded. The scissor-like elongations connecting the hooks 103 with the release buttons 106 are connected through a hinge 104.
Figure 2:
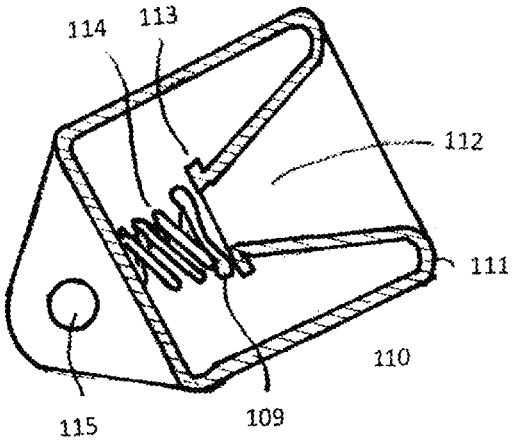

When the tongue 101 is inserted into the clasp 110, the spheroidal tip of the tongue will be guided into the internal channel 112 until the tip reaches and meets the cap 109 of the ejector spring 114. As the hooks pass the point of indentation 113, the hooks 103 will lock inside the internal channel. To release the tongue, pressing the release buttons 106, will retract the hooks 103, and the pressure of the ejector spring 114 will move the tongue into unlocked position. In some applications for seat-belts the clasp may be connected to the seat through a hole 115 in the base of the clasp, while the webbing may be passed through the hole 108 of the tongue unit, and vice versa. The tongue unit has a gripping handle formed in the shape of bulk with round shape 107 to match the omni-directional nature of the tongue also provides ergonomic advantage and convenience in the fastening of the belt.

Figure 3:
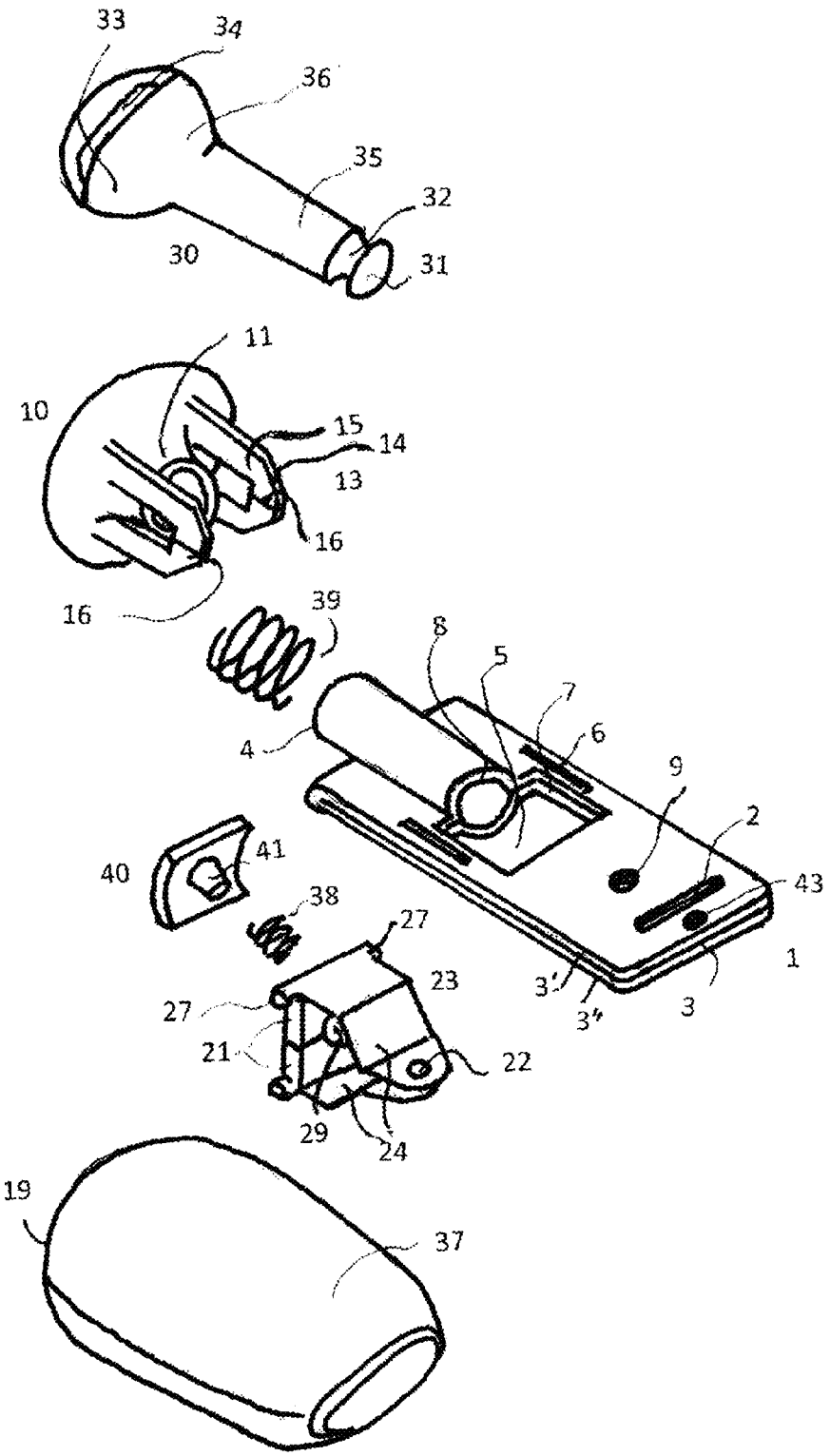

FIG. 3 shows an exploded illustration of another embodiment of the locking fastener system ("the fastener") comprising of a "tongue" and a "catch" where the tongue is passive and the catch has the active components to engage locking mechanism when the tongue is inserted.

Figure 4:
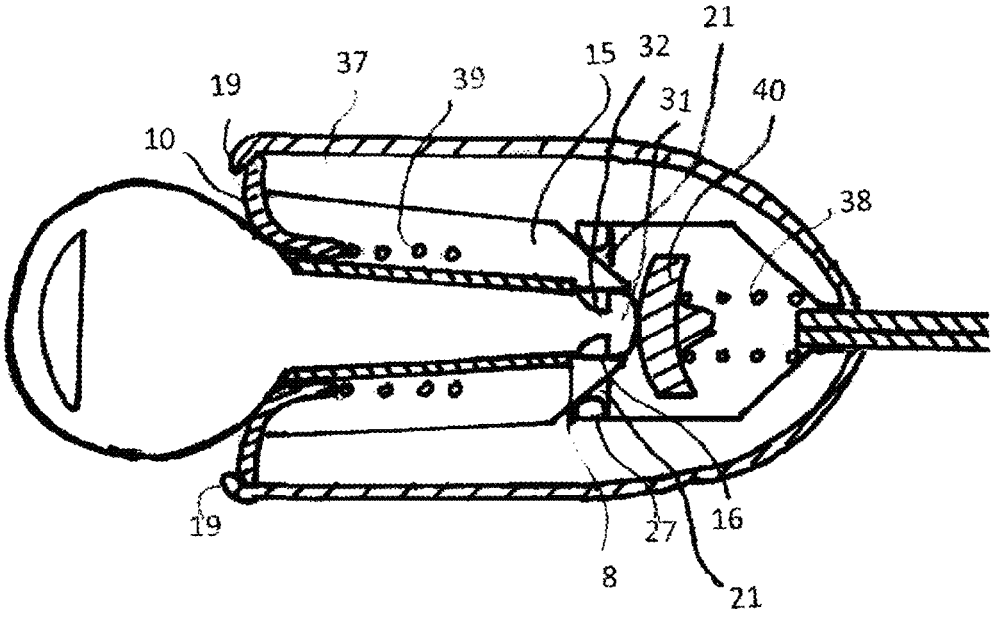
Figure 5:
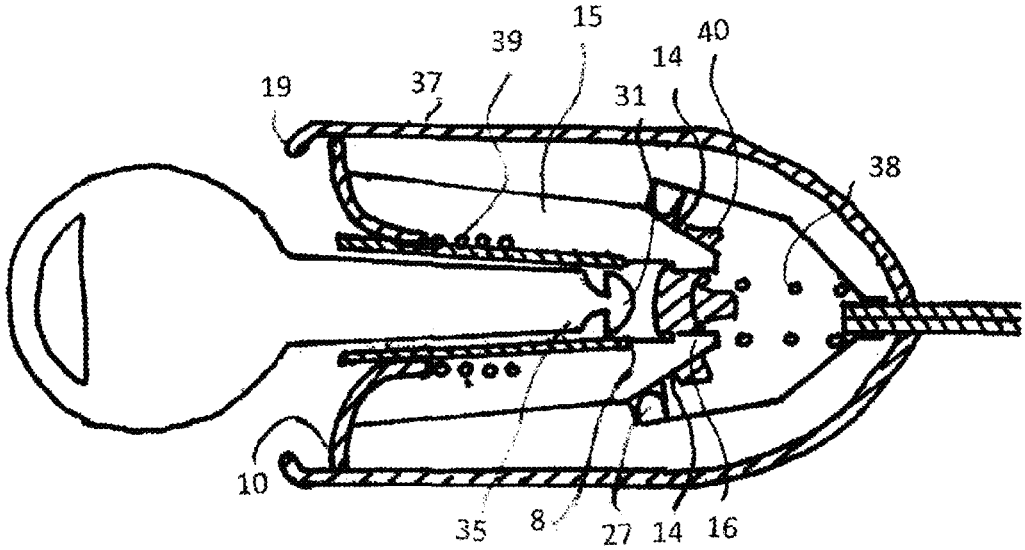

FIGS. 4 and 5 show side sections of the fastener according to FIG. 3, after inserting the insertion tongue and in locked position (FIG. 4) and in an unactuated released position (FIG. 5)

The top portion of the FIG. 3 shows the tongue 30 which has a round shaft 35 with spheroidal head 31 and a groove 32 around the shaft under the head. For such applications as seat belt buckles, the tongue has a hole 34 where the webbing of a seatbelt may be inserted. The tongue has a round knob 33 for the non-directional gripping and assisted handling of the shaft as the force will be in the same axis as the direction of the movement of the tongue in the pushing action, to provide wider accessibility to users of different levels of dexterity when inserting the tongue into the catch to engage the locking mechanism. Two possible ways to limit the travel of the tongue into the insertion channel 4 of the catch plates are provided. One of which is by the tapering in the shape of the shaft 35 and matching insertion channel 4 of the catch plates. The other being the shape and placing of the bulk 36 at the left end of the tongue 30. The rest of the FIG. 3 shows the parts comprising the catch. The base for the catch are two base plates, 3' and 3" (collectively, "plates" or "3") which at the flat end has openings 2 and 43, for fastening to a free belt band end 2 or to a fitting fastened to the floor of the vehicle 43, for example. These plates are bonded with each other and form the base frame for the catch. On the non-free end of the plates 3, is a barrel-shaped insertion channel 4 for the tongue, for which the two plate parts 3' and 3", in connection with the opening 4, form an insertion path. In the center of the plates 3, a latching-bars opening 5 is present for the insertion of a set of latching bars 21, described below, perpendicularly to the insertion path. Attachable to the plates 3 are two leaf springs 24, which are riveted to the plates 3 through the common holes 9 and 22 and these two springs hold the latching bars 21 inside the plates' opening. The latching bars 21, upper and lower, each has semi-circle cutouts, forming a choking hole 29 to match the shape of the groove 32 on the tongue. The matching of the shape of the arcs in the latching bars to the groove 32 of the tongue, result the hole to be shaped in such a way that the head 31 of the tongue may pass through the hole 29 with minimal movement of the latching bars but disallow escaping unless the latching bars are completely open as the hole is larger on the left side than the right side. The end of the insertion channel 4 also form a wall 8 against which the latching bars 21 are butted after the tongue is inserted and locked by the latching bars. The release keys 15 are given their stability through the guide holes 6 on the plate. A set of bar guide holes 6 guide the movement of the four release keys 15 with their prongs 16 inside the guide holes. The release button 10, is a funnel shaped pressure key, which is supported by and movable parallel within the insertion path formed by the outer casing 37, and is attached to four release keys 15. The funnel shaped flaring tube 11 in the center of the release button serves as the flaring outer opening of the catch for the tongue and it covers the insertion channel 4 of the clasp. The release button's outward pressure is kept by a spring 39 wrapped around the left-end of the insertion channel 4, and is kept inside the casing 37 through its indentation 19 at the end. The inner end of the insertion channel 8 function as a wall for the latching bars, and once locked, stands as a barrier for the latching bars from letting the tongue escape from their grip in the fashion of a choke hold. The non-directional shape of the tongue combined with the choke-hold of the latching bars enables the tongue to pivot inside the catch while maintaining the lock, once engaged. The release keys 15 have slanted outer ramps 14 which slide under the lifting arms 27 on the each end of the latching bars 21. The opening 5 inside the plates 3 also house the ejector 40 and the ejector spring 38 which holds and presses the knob 41, which in turn, presses the tip of the tongue 31 for releasing the tongue when unlocked as well as holding the tongue in steady position with the latching bars butted against the inner wall 8 while locked.

FIG. 4 shows the position of the tongue and clasp where the release button is in extended position, in which the tongue is locked inside the clasp. The tip 31 of the tongue is pushed against the ejector 40 by the force of the spring 38, and the tongue 30 is strangled at its circular groove 32, in the hole 29 formed by the arcs of the latching bars 21, which arcs are carved to match the shape of the circular groove of the tongue, and the latching bars are butted against the end wall 8 of the insertion channel to resist pulling once latched, while allowing the tongue to pivot inside the hole. The spring 39 and the end indentation 19 of the casing 37 keep the release button 10 within the casing at an extended position.

FIG. 5 shows the position of the fastener in which the tongue is being released as the release button moves from extended position to retracted position. The release button 10 has been pushed against the pressure of the spring 39, and the release keys 15 moved along the path on the plates 3, lifting the lift arms 27 of the latching bars through their slanted ramps 14. The ejector 40 has been pressed outward until it was stopped by the latching bars, moving the tongue away from the choke-hold of the latching bars.

Figure 6:
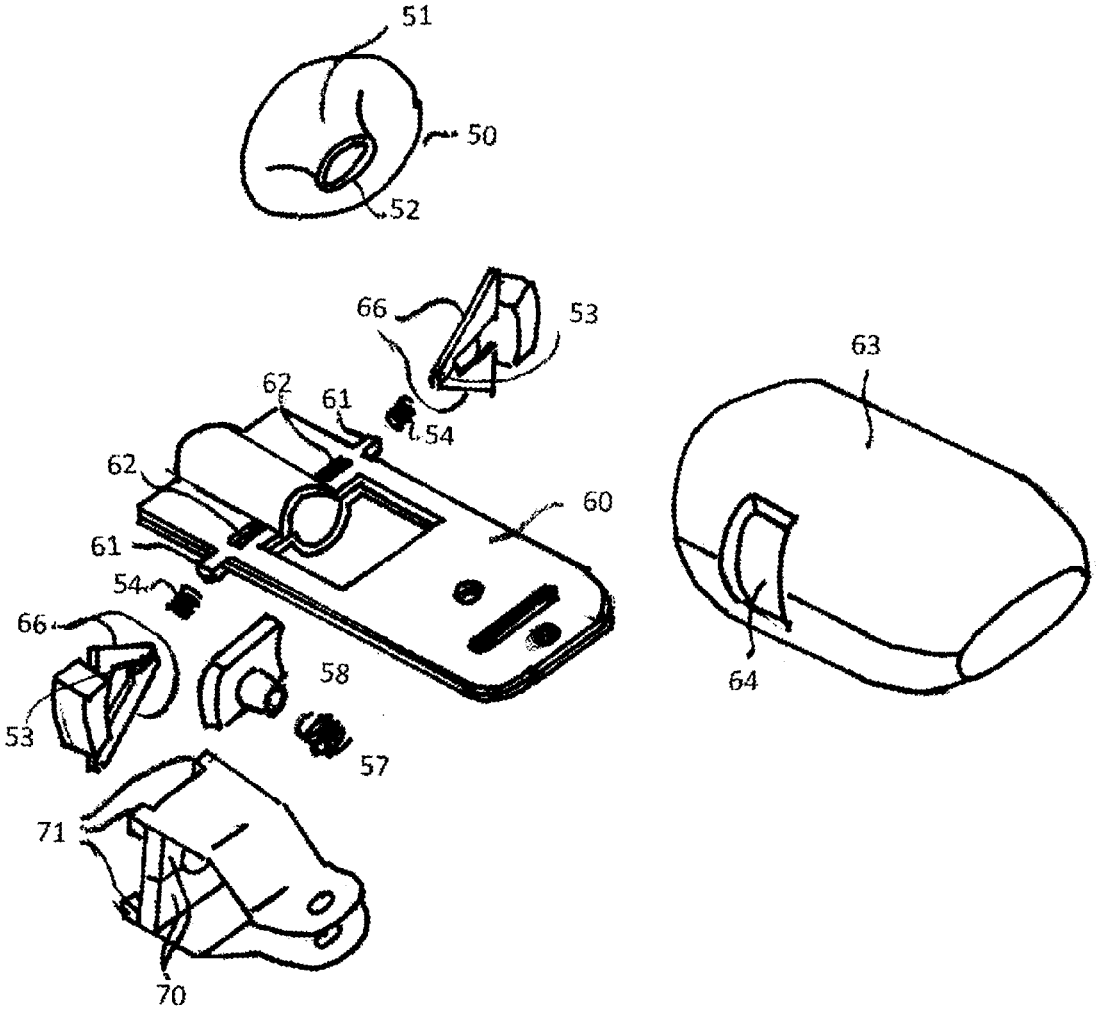

FIG. 6 shows another embodiment of the design, similar to the embodiment of FIGS. 3 through 5, with an identical tongue to the previous embodiment as well as the locking mechanism allowing free-pivot of the tongue while locked, the difference being that the catch incorporates release buttons positioned on the side of its casing, which predicates a squeezing action as opposed to the pressing for releasing the lock. The funnel-shaped opening 51 attached to the insertion channel of the base plates is stationary. Two release buttons 53 are located on both sides of casing 63 and laterally placed in relation to the funnel-shaped opening 51. The release buttons are held outward by two springs 54, located at each end of the protrusions 61 on the base plates 60. The release buttons are held by the matching cut-outs 64 of the casing 63. The keys 65 connected to the release buttons 53 work in the same way as the previous embodiment, and their slanted ramps 66 lift the latching bars as they slide their slanted ramps under the arms 71 of the latching bars 70. The guide holes 62 of the main plates 60 hold the protrusions 53 of the release keys in place and act as railing.

What is claimed is:

1. A non-directional, locking fasteners for seatbelts to allow quick and secure connection and quick release, indiscriminant of the directional orientation, comprising a tongue and a receiving clasp which are cooperatively structured to allow secure locking engagement;

said tongue comprising a spheroidal and transversely isotropic tip progressively connected to a conical and transversely isotropic shell portion which is successively and progressively connected to a cylindrical shell; and an internal structure comprising two spring-loaded locking hooks protruding out of the conical shell portion adjacent the tip for latching and locking, and a quick release mechanism for disengagement of the hooks, the cylindrical shell portion progressively connected to a gripping handle base, also in isotropic shape with the exception for a hole for passing the webbing of a seatbelt successively connected to the gripping handle base;

said receiving clasp comprising a flaring reverse-conical opening that is shaped to correspond to and exactly match the profile of the conical shell portion of said tongue such that the tongue may be inserted into the clasp in al lateral-directional orientations;

an internal channel, at a smaller end of the reverse-conical opening, having an indentation ring; the tongue configured to extend through the internal channel such that the locking hooks positively engage the ring in a locking position free from accidental release once locked, and an internal ejecting mechanism comprising of an ejector spring embedded within an internal end of the receiving clasp and which spring is connected to a cap corresponding in shape to the spheroidal tip of the tongues.

2. The fastener as claimed in claim 1, wherein the reverse-conical opening of the clasp is transversely isotropic and shaped to match the conical shape of the tongue including an exact angle of the conical part of the tongue successively connected to the spheroidal tip to allow indiscriminant insertion of the tongue into the insertion channel of the clasp as well as permitting on-axis rotational movement of the tongue while in a secure locking engagement with the clasp.

3. The fastener as claimed in claim 1, wherein the conical shell portion of the tongue matches an angle and length of the reverse-conical opening, preventing the tongue from traveling further within the clasp after it reaches a locking position and wherein tension caused by pressure of the ejector spring against the tip of the tongue and the hooks against the indentation of the sidewall maintains engagement of the tongue and clasp.

4. The fastener as set forth in claim 1, wherein the gripping handle has a spherically bulked shape at the opposite end from the spheroidal tip for non-directional gripping and indiscriminant insertion of the tongue into the clasp, while allowing the passing of the webbing of a seatbelt through the hole within the gripping handle.

5. The fastener as set forth in claim 1 where the hooks have internal angles less than 90 degrees to lock with the indentation ring of the receiving clasp without allowing slipping while in locked position and positioned to latch and lock when pressed against the internal ejecting mechanism of the receiving clasp at the indentation ring.

* * * * *